US007398888B1

(12) United States Patent
Nowak

(10) Patent No.: US 7,398,888 B1
(45) Date of Patent: Jul. 15, 2008

(54) SPORTS EQUIPMENT STORAGE RACK

(76) Inventor: Gregory Nowak, 6400 Theresa Dr., Johnston, IA (US) 50131

( * ) Notice: Subject to any disclaimer, the term of this patent is extended or adjusted under 35 U.S.C. 154(b) by 390 days.

(21) Appl. No.: 10/989,576

(22) Filed: Nov. 16, 2004

(51) Int. Cl.
*A47F 7/00* (2006.01)

(52) U.S. Cl. ..... 211/59.2; 211/14; 206/315.9; 220/485

(58) Field of Classification Search ..... 211/15, 211/85.31; 206/315.9; 224/919, 251; 280/47.26; 294/19.2; D6/566; 220/485
See application file for complete search history.

(56) References Cited

U.S. PATENT DOCUMENTS

| | | | | |
|---|---|---|---|---|
| 3,064,823 | A | 11/1962 | Shock | |
| 3,265,246 | A * | 8/1966 | Messenger | 221/283 |
| 3,371,795 | A * | 3/1968 | Rosonke | 211/14 |
| 3,627,317 | A * | 12/1971 | Whitsitt | 273/447 |
| 4,088,251 | A | 5/1978 | Rodriguez | |
| 5,472,189 | A | 12/1995 | Pfeiffer et al. | |
| 5,533,646 | A * | 7/1996 | Dildine | 221/185 |
| 5,765,700 | A * | 6/1998 | Donne | 211/85.31 |
| 5,823,360 | A | 10/1998 | Gorosave | |
| 6,439,424 | B1 | 8/2002 | Threadgill | |
| 6,481,595 | B1 | 11/2002 | Chilton | |
| 6,663,119 | B2 * | 12/2003 | White | 280/47.26 |
| 6,719,306 | B2 * | 4/2004 | White | 280/47.26 |
| D497,750 | S * | 11/2004 | Ruffell | D6/515 |
| 2006/0186000 | A1 * | 8/2006 | Gregory et al. | 206/315.9 |

* cited by examiner

*Primary Examiner*—James Kramer
*Assistant Examiner*—Jared W. Newton
(74) *Attorney, Agent, or Firm*—G. Brian Pingel; Camille L. Urban

(57) ABSTRACT

A sports equipment storage rack for supporting a variety of sports equipment in an off the ground position includes an elongated cylindrically shaped body of a wire type cage construction that is sized to hold a plurality of spherically shaped balls and has an arcuately shaped top portion for receiving the balls and a bottom portion that is arcuately formed to provide a ramp for discharging the balls from the rack.

16 Claims, 6 Drawing Sheets

SPORTS EQUIPMENT STORAGE RACK

BACKGROUND OF THE INVENTION

1. Field of the Invention

The present invention relates in general to a storage rack for holding and supporting in an off the ground position a wide variety of sports equipment, and more specifically resides in a sports rack that is formed of a cage type structure to provide a light weight but durable and convenient space saving equipment storage device.

2. Description of the Prior Art

A wide variety of devices have been developed for use as sports equipment holders that are highly advantageous for use with recreational facilities or garages associated with residential homes. Preferably, such sports equipment holders are adapted to accommodate many different types of sports equipment such as basketballs, baseballs, baseball gloves, footballs, baseball bats, rackets, etc.

A number of known equipment sports racks are formed with a vertically oriented cylindrically shaped body portion for conveniently serving as a storage device for spherical objects such as basketballs, golf balls or table tennis balls. For example, in U.S. Pat. No. 6,481,595 B1 a ball storage and dispensing device is disclosed that is primarily intended for mounting onto golf carts to store and dispense golf balls. The dispensing device includes a tube shaped body with an open top into which balls may be dropped and a side opening at the bottom from which the balls may be removed.

Another type of golf ball storage device is disclosed in U.S. Pat. No. 6,439,424 B1 and includes a tubular shaped body that is provided with a mounting bracket for attaching the device to a support structure. Other somewhat similar-type ball equipment holders are described in U.S. Pat. No. 3,064,823 that provides a cylindrical shaped body for storing a plurality of table tennis balls and U.S. Pat. No. 4,088,251 which discloses a generally L-shaped cylindrically shaped device for the storage of a plurality of tennis balls. The device includes a lower leg portion from which the balls may be dispensed by tipping the device to urge the balls to roll out of a lower end. Similarly, U.S. Pat. No. 5,472,189 discloses a table tennis storage and dispensing device with a tubular shaped body for again storing a plurality of table tennis balls. Such device has a lower dispensing end that is sized to be somewhat smaller than the size of the tennis balls, but the body has portions that can be flexed in the direction of force to temporarily widen the bottom opening to allow dispensing of the lower most ball therein.

In addition to the above-described prior art devices, U.S. Pat. No. 5,823,360 discloses a multi-purpose support rack that is adapted for holding sports equipment, beverage containers, clothing, jewelry and other things. Such support rack includes an elongated pole-type support member to which a variety of other types of support structures are attachable. One of the attachable support structures is a cylindrically shaped receptacle that is designed to store a plurality of balls. The receptacle is formed of several spaced apart vertical members that are connected together at their upper and lower ends by a top loop and a bottom loop. To retain the balls in the receptacle, the lower loop has an inside diameter slightly smaller than the diameter of the balls to prevent them from exiting through the lower end of the receptacle.

Although the above described sports equipment support assemblies provide convenient arrangements for storing selected types of sports equipment, none of the disclosed devices are formed of a durable and lightweight cage configuration that can be conveniently mounted on the side of a building wall and is adapted to include a wide variety of sports equipment holders so that many different types of sports equipment can be readily and easily supported thereby.

SUMMARY OF THE INVENTION

The present invention is adapted to provide a sports equipment storage rack for supporting a wide variety of sports equipment in an off the ground position and includes a generally cylindrically shaped body of a wire-type cage construction that is sized to hold a plurality of spherically shaped balls, a generally tubular shaped top portion for said body that is arcuately formed to provide an upper opening for receiving said balls and a bottom portion for said body that is arcuately formed to provide a bottom opening for the controlled dispensing of said balls.

Preferably, the body is formed of a plurality of spaced apart vertically oriented frame struts that are connected together by a plurality of spaced apart generally arcuate span members to provide a frame-type construction that is lightweight, but yet of a durable condition. Also, due to the arcuate shape of the top and bottom portions for said body, the upper portion has an upper opening that faces toward the front of said body and the bottom portion curves toward the front of said body.

To provide for the support of other types of sports equipment besides spherically shaped balls, the storage rack includes a plurality of sports equipment hangers that are associated with said body portion and are formed with a socket and a support device adapted for receiving a particular type of sports equipment. Each support device is formed with a handle that is receivable in said socket so that the sports equipment hangers can be interchangeable with one another depending upon the type of sports equipment to be supported by the sports rack.

The foregoing and other advantages of the present invention will appear from the following description. In the description, reference is made to the accompanying drawings which form a part hereof, and in which there is shown by illustration and not of limitation a specific form in which the invention may be embodied. Such embodiment does not represent the full scope of the invention, but rather the invention may be employed in a variety of other embodiments and reference is made to the claims herein for interpreting the breadth of the invention.

DETAILED DESCRIPTION OF THE PREFERRED EMBODIMENT

Figure 1:
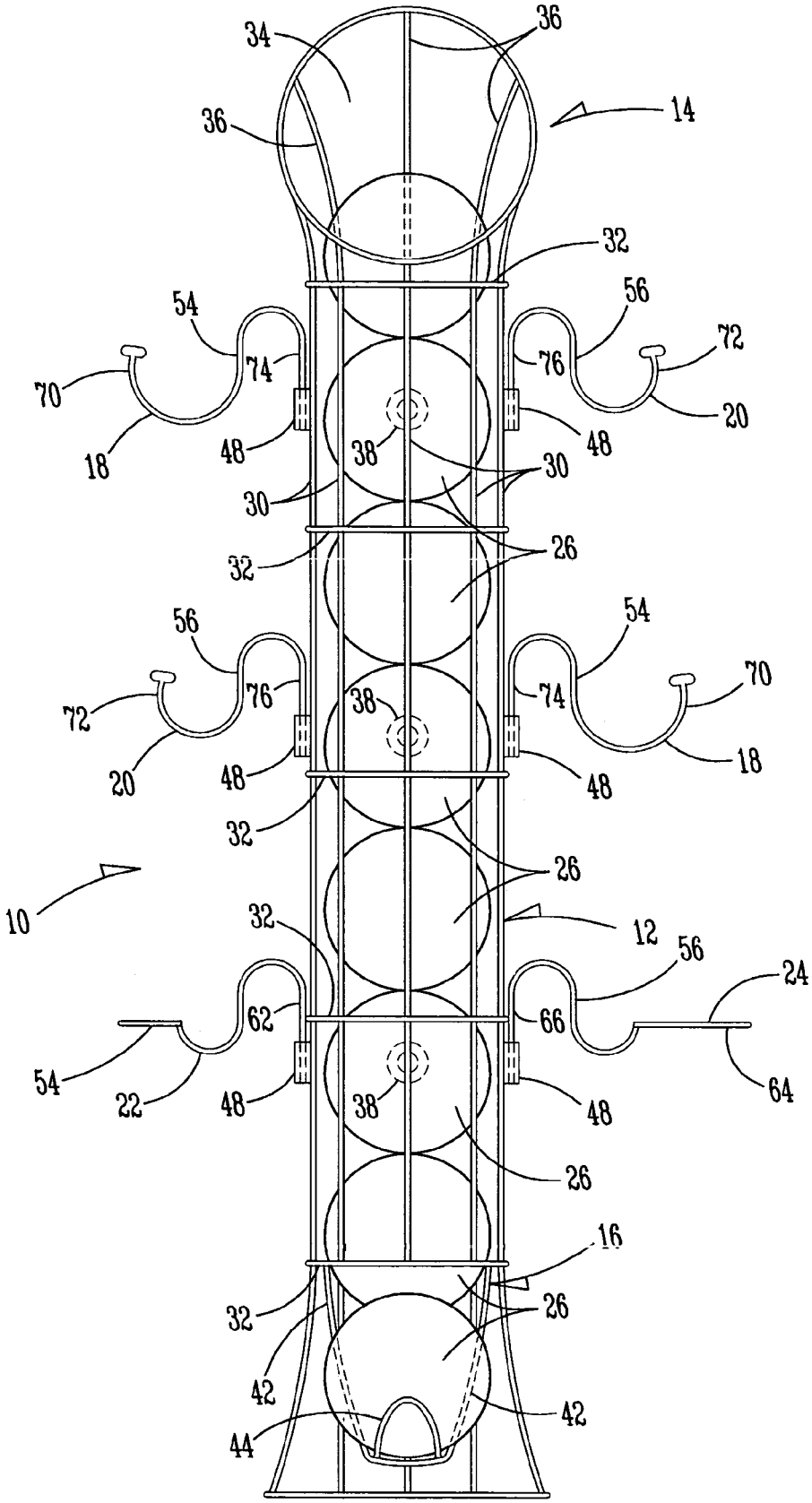
FIG. 1 is a front view in elevation of a preferred embodiment of a sports equipment storage rack of the present invention that includes a body, top and bottom portions for said body and interchangeable sports equipment hangers that are formed of sockets and support devices for receiving particular types of sports equipment.

Referring now to the drawings and with reference first to FIG. 1, a front view of a preferred embodiment of the sports equipment storage rack of the present invention is shown at 10 and is adapted for supporting a wide variety of different types of sports equipment in an off the ground position in a manner that the sports equipment is easily visible and is supported in an organized fashion.

The sports rack 10 is formed of a cylindrically shaped, elongated body 12 that is vertically oriented and is associated with a top portion 14, a bottom portion 16 and a plurality of different types of sports equipment hangers 18, 20, 22 and 24 secured to the body 12 in a spaced apart relationship. As can readily be seen, the body 12 is of a sufficient length so that it can easily store a number of large spherical shaped balls 26 such as basketballs or soccer balls in a stacked arrangement.

Figure 2:
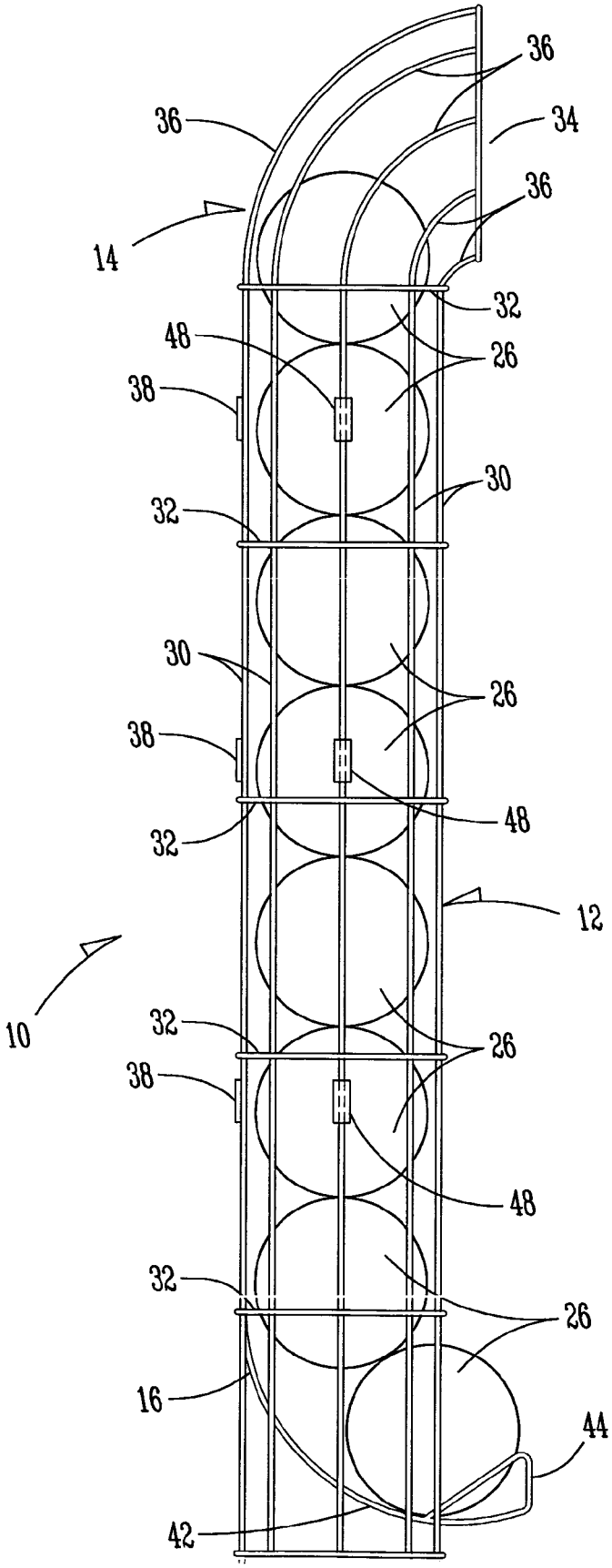
FIG. 2 is a side view in elevation of the embodiment of FIG. 1 with the hanger sports devices removed.

As can further be seen from FIGS. 1 and 2, the body 12 is formed of a wire-type cage construction that includes a plurality of spaced apart vertically oriented frame struts 30 that are connected together preferably by spaced apart generally arcuate span members 32. Preferably, the vertical struts 30 and the span members 32 are formed from a heavy gauge metal or a high strength PVC plastic material. Consequently, such design provides a construction that is durable and strong and yet is relatively lightweight so that the rack 10 can be relatively easily installed onto a wall through the use of circularly shaped mounting members 38 secured to the back of the body 12. As illustrated by FIGS. 1 and 2, due to the wire-type cage construction of the body 12, the balls 26 contained in the body 12 are readily visible and accessible from the front or sides, which permits one to remove the balls 26 from the rack 10 either from the bottom portion 16 or from the top portion 14 if so desired.

To place the balls 26 into the rack 10, the balls are directed through an opening 34 formed by the top portion 14. As can best be seen from FIG. 1, the top portion 14 is formed by an extension of the vertical struts 30 which terminate in arcuately shaped, flared out end portions 36 so that the opening 34 is provided with a larger diameter than that of the body 12 or the balls 26 to permit the placement of the balls 26 into the opening 34 with relative ease. Preferably, the end portions 36 of the struts 30 are shorter in the front than in the back so that the opening 34 faces in a generally frontward direction with respect to the body 12, which also assists in making the placement of the balls 26 in the rack 10 easier.

As indicated in both FIGS. 1 and 2, the lower most ball 26 is stored in a position outside of the body 12 and is supported by the bottom portion 16. Preferably, the bottom portion 16 is formed of a pair of arcuately shaped downwardly extending struts 42 that form a ramp that terminates in a ball retention wedge shaped node 44 that extends upwardly from the struts 42. Thus, the retention node 44 prevents the balls 26 from unintentionally falling out of the rack 10, but retains the lower most ball 26 in a convenient location in the bottom portion 16 for removal from the rack 10 when desired. Thus, placement of the balls 26 into the sports rack 10 and removal therefrom when desired can be readily and easily accomplished with relative ease. The bottom also includes a generally circularly shaped stand portion 46 that extends beneath the struts 42 to serve as a support platform for the rack 10 in the event it is desired to have it positioned on the floor. In such event, wall attachments should also be used for stabilization purposes.

Figure 3A:
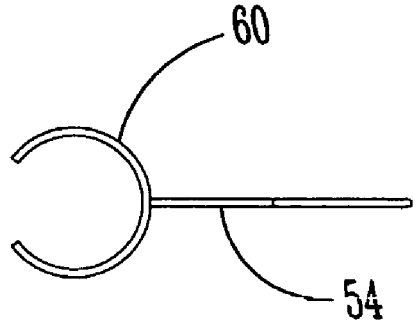
FIG. 3*a* is a plan view of a bat support device.
Figure 3B:
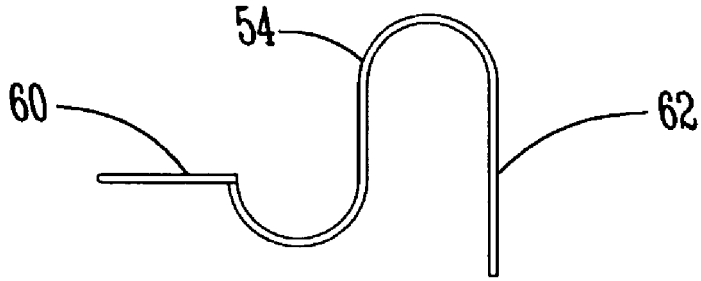
FIG. 3*b* is a side view in elevation of the bat support device shown in FIG. 3*a;*

As previously described, to provide a means for supporting other types of sports equipment besides the balls 26, the sports rack 10 includes the various types of sports equipment hangers 18-24 as shown in FIG. 1. Preferably, the hangers 18-24 include a plurality of bases 48 in the form of sockets that are all of a similar size and shape, but the hangers 18-24 differ from one another by including different types of support members 50-58 that are adapted to support a particular type of sports equipment. For example, as indicated by FIGS. 3*a* and 3*b*, the support member 54 for the hanger 22 has a C-shaped outer end 60 for receiving the handle of a bat and an inner end 62 that is essentially straight for placement into one of the bases 48.

Figure 4A:
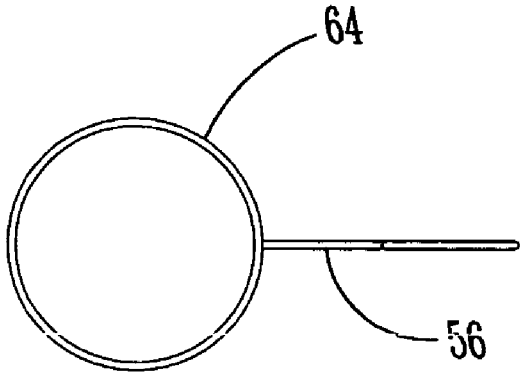
FIG. 4*a* is a plan view of a football support device.
Figure 4B:
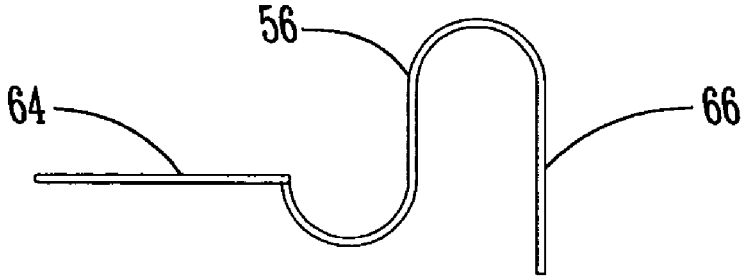
FIG. 4*b* is a side view in elevation of the football support device of FIG. 4*a;*

Referring now to FIGS. 4*a* and 4*b*, the hanger 24 is formed with a support member 56 having a circularly shaped outer end 64 in which a football may be positioned and a straight inner end 66 for insertion into one of the bases 48. To provide a general purpose hanging capability for the sports rack 10, the hangers 18 and 20 have support members 54 and 56 with single prong ends 70 and 72 respectively on which sporting equipment such as skate boards, baseball catching or batting gloves or catching masks may be hung.

Figure 5:
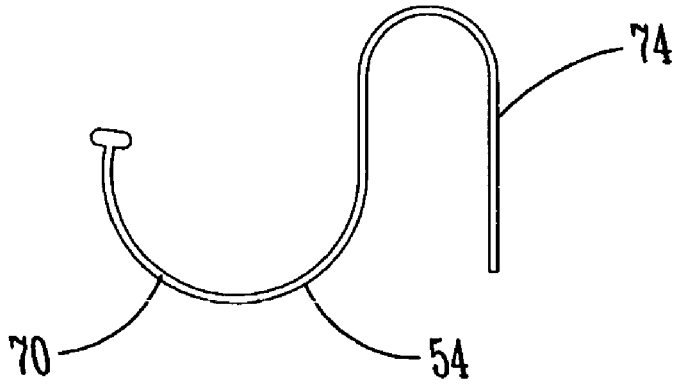
FIG. 5 is a side view in elevation of a large hook shaped support device.
Figure 6:
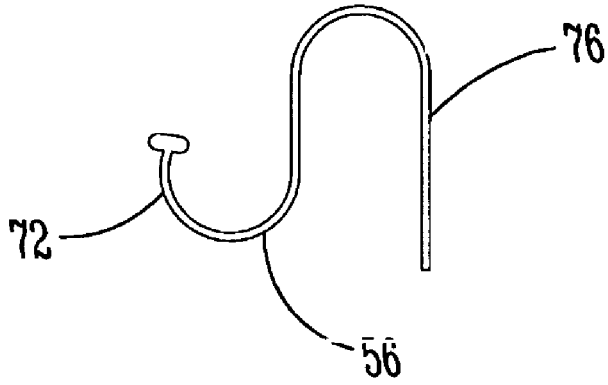
FIG. 6 is a side view in elevation of a small hook shaped support device.

As can be seen from FIGS. 5 and 6, the only difference between the hangers 18 and 20 is that the hanger 18 is of a somewhat larger size than that of the hanger 20 to accommodate larger types of sports equipment. Again, the hangers 18 and 20 include straight inner ends 74 and 76 for being received in one of the bases 48 as desired. As should readily be obvious, because of the use of the socket type bases 48, the position of the hangers 18-24 with respect to the body 12 can be readily varied as desired by a user or as dictated by the particular type of sports equipment to be supported thereby.

Figure 7:
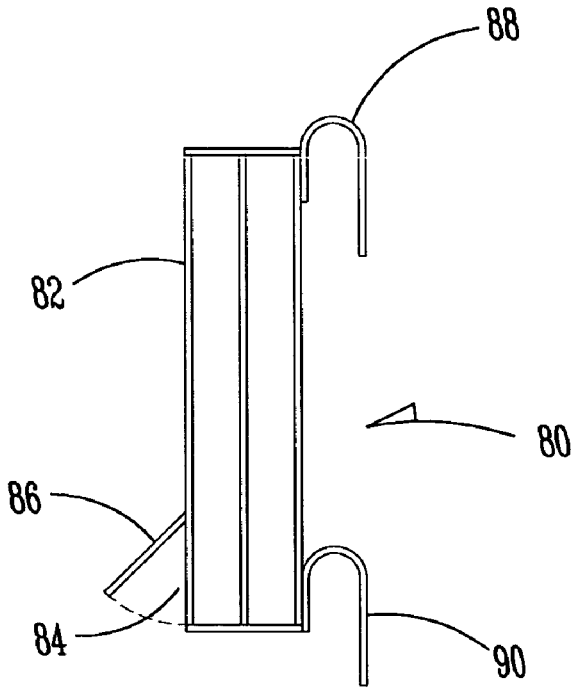
FIG. 7 is a side view in elevation of a small ball holder.

In addition to the hangers 18-24, the sports rack 10 may also include a small ball holder 80, as shown in FIG. 7 and designed to hold whiffle balls, baseballs or golf balls or the like. The holder 80 has a cylindrical shaped body 82 with a lower opening 84 that can be closed off by a hinged door 86. Mounting of the holder 80 on the rack 10 is accomplished by upper and lower mounting hooks 88 and 90 respectively.

Thus, the present invention provides a sports equipment storage rack that is adapted for holding a wide variety of sports equipment and is of a cage-type construction that results in a relatively lightweight, but durable structure. Although the sports rack of the present invention has been described with respect to a preferred embodiment, it should be understood that such embodiment may be altered without avoiding the true spirit and scope of the present invention as described in the following claims.

What is claimed is:

1. A sports equipment storage rack for supporting a variety of different types of sports equipment in an off-the-ground position, said rack comprising:

(a) an elongated, cylindrically shaped body of a wire-type cage construction formed of a plurality of spaced apart vertically oriented frame struts that are connected together by a plurality of spaced apart generally arcuate span members;

(b) said body sized to hold a plurality of spherically shaped balls;

(c) said vertically oriented struts having arcuately shaped end portions that flare outwardly from said body;

(d) a generally tubularly shaped top portion on the top end of said body that is formed from said end portions to provide a circular upper opening for receiving said balls, the diameter of said upper opening being larger than the diameter of said body to enable the placement of said balls in said opening;

(e) said end portions being of differential length such that said upper opening generally lies in a vertical plane; and (f) a bottom portion on the lower end of said body that is arcuately formed to provide a ramp for holding said balls and has an upwardly extending wedge shaped retention node to normally retain said balls in said rack, said ramp extending from said body such that said node is located outside of said body.

2. The sports rack as described in claim 1, wherein said top portion is of a wire-type cage construction and said upper opening is outwardly flared to enable the placement of said balls in said opening.

3. The sports rack as described in claim 1, wherein said bottom portion is of a wire-type construction for holding a plurality of spherically shaped balls.

4. The sports rack as described in claim 1, wherein a plurality of sports equipment hangers extend from said body for holding certain of the sports equipment supported by said rack.

5. The sports rack as described in claim 4, wherein said sports equipment hangers are each formed with a socket attached to said body and a support device adapted for receiving a particular type of sports equipment.

6. The sports rack as described in claim 5, wherein said rack has at least one mounting member attached to at least one of said vertically oriented frame struts positioned at the back of said body for mounting said rack on a vertically oriented wall.

7. The sports rack as described in claim 6, wherein said sockets of said equipment hangers are attached to at least one of said frame struts.

8. The sports rack as described in claim 5, wherein said support devices are semi-permanently associated with said sockets.

9. A sports equipment storage rack for supporting a variety of different types of sports equipment in an off-the-ground position, said rack comprising:

(a) an elongated, cylindrically shaped body of a wire-type cage construction formed of a plurality of spaced apart vertically oriented frame struts that are connected together by a plurality of spaced apart generally arcuate span members;

(b) said body sized to hold a plurality of spherically shaped balls;

(c) said vertically oriented struts having arcuately shaped end portions that flare outwardly from said body;

(d) a generally tubularly shaped top portion on the top end of said body that is formed from said end portions to provide a circular upper opening for receiving said balls, the diameter of said upper opening being larger than the diameter of said body to enable the placement of said balls in said opening;

(e) said end portions being of differential length such that said upper opening generally lies in a vertical plane; and (f) a bottom portion on the lower end of said body that is arcuately formed to provide a ramp for holding said balls and has an upwardly extending retention node to normally retain said balls in said rack, said ramp extending from said body such that said node is located outside of said body.

10. The sports rack as described in claim 9, wherein said top portion is of a wire-type cage construction and said upper opening is outwardly flared to enable the placement of said balls in said opening.

11. The sports rack as described in claim 9, wherein said bottom portion is of a wire-type construction for holding a plurality of spherically shaped balls.

12. The sports rack as described in claim 9, wherein a plurality of sports equipment hangers extend from said body for holding certain of the sports equipment supported by said rack.

13. The sports rack as described in claim 12, wherein said sports equipment hangers are each formed with a socket attached to said body and a support device adapted for receiving a particular type of sports equipment.

14. The sports rack as described in claim 13, wherein said rack has at least one mounting member attached to at least one of said vertically oriented frame struts positioned at the back of said body for mounting said rack on a vertically oriented wall.

15. The sports rack as described in claim 14, wherein said sockets of said equipment hangers are attached to at least one of said frame struts.

16. The sports rack as described in claim 13, wherein said support devices are semi-permanently associated with said sockets.

* * * * *